US009683487B2

(12) United States Patent
Miyagi

(10) Patent No.: US 9,683,487 B2
(45) Date of Patent: Jun. 20, 2017

(54) OUTBOARD MOTOR

(71) Applicant: YAMAHA HATSUDOKI KABUSHIKI KAISHA, Iwata-shi, Shizuoka (JP)

(72) Inventor: Yuta Miyagi, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 0 days.

(21) Appl. No.: 15/058,499

(22) Filed: Mar. 2, 2016

(65) Prior Publication Data

US 2016/0356252 A1 Dec. 8, 2016

(30) Foreign Application Priority Data

Jun. 3, 2015 (JP) ..... 2015-113172

(51) Int. Cl.

| | |
|---|---|
| ***F02B 61/04*** | (2006.01) |
| ***F02M 37/00*** | (2006.01) |
| ***B63H 20/00*** | (2006.01) |
| ***F02B 75/22*** | (2006.01) |
| ***F02M 59/44*** | (2006.01) |
| ***F02P 13/00*** | (2006.01) |
| ***F02F 7/00*** | (2006.01) |
| ***F02F 1/24*** | (2006.01) |
| ***F02M 69/04*** | (2006.01) |

(52) U.S. Cl.

CPC ..... *F02B 75/22* (2013.01); *F02B 61/045* (2013.01); *F02F 1/242* (2013.01); *F02F 7/0012* (2013.01); *F02M 59/44* (2013.01); *F02M 69/045* (2013.01); *F02P 13/00* (2013.01)

(58) Field of Classification Search

CPC .. B63H 20/00; B63H 20/001; B63H 2020/00; F02B 61/045; F02B 75/22; F02M 39/02; F02M 55/025; F02M 37/0017; F02M 59/44; F02P 13/00; F02F 7/0012

USPC ..... 440/88 F

See application file for complete search history.

(56) References Cited

U.S. PATENT DOCUMENTS 6,220,217 B1 * 4/2001 Kato ..... F02B 61/045 123/198 D
6,321,711 B1 * 11/2001 Kato ..... F02B 61/045 123/195 A (Continued)

FOREIGN PATENT DOCUMENTS

JP 10-331640 A 12/1998

*Primary Examiner* — Daniel V Venne

(74) *Attorney, Agent, or Firm* — Keating and Bennett, LLP

(57) ABSTRACT

An outboard motor includes a crankshaft, a first bank including a plurality of first cylinders, a second bank including a plurality of second cylinders, a plurality of first injectors, a plurality of first spark plugs, a plurality of second injectors, and a plurality of second spark plugs. Each of the first and second cylinders includes a combustion chamber, an intake port, and an exhaust port. The first injectors and the first spark plugs are alternately disposed in a vertical direction. The second injectors and the second spark plugs are alternately disposed in the vertical direction in a reverse order to that of the first injectors and the first spark plugs. When the crankshaft is seen from a horizontal direction, the first cylinders and the second cylinders are disposed symmetrically about a point of symmetry arranged on an axis of the crankshaft.

10 Claims, 8 Drawing Sheets

(56) References Cited

U.S. PATENT DOCUMENTS 6,354,278 B1 * 3/2002 Kawasaki ..... F01L 1/053
123/195 A
6,450,847 B1 * 9/2002 Kashima ..... F01M 11/03
440/88 A

* cited by examiner 16b
38
38a
38b
28b
38c
35
34
25b
39
27b
24b
23
22
62
61
UP
DOWN

OUTBOARD MOTOR

BACKGROUND OF THE INVENTION

1. Field of the Invention

The present invention relates to an outboard motor.

2. Description of the Related Art

A type of engine, including a plurality of cylinders and a plurality of pairs of injectors and spark plugs, is well-known (see Japan Laid-open Patent Application Publication No. H10-331640). The cylinders are aligned in a predetermined direction, and each injector and spark plug is mounted to each cylinder. Each of the plurality of cylinders includes a combustion chamber, intake ports, and exhaust ports. The injectors and the spark plugs are alternately disposed in the predetermined direction, and are inserted through a delivery pipe extending in the predetermined direction.

It is assumed that a V-shaped engine includes a first bank and a second bank of cylinders, each of which is of the same type as the plurality of cylinders described in Japan Laid-open Patent Application Publication No. H10-331640, about a crankshaft. To produce either an intake manifold or an exhaust manifold as a single component in this construction, it is required to reverse the positions of the intake ports and those of the exhaust ports between the first bank and the second bank.

Therefore, when the same arrangement order of the injectors and the spark plugs is used in the first bank and the second bank, this inevitably results in a difference in positions of the injectors with respect to both the intake ports and the exhaust ports between the first bank and the second bank. Thus, it is not easy to use a common construction for a fuel supply system including the injectors in the first bank and that in the second bank.

SUMMARY OF THE INVENTION

In view of the above-described problem, preferred embodiments of the present invention provide an outboard motor in which a common construction is used for the fuel supply systems respectively including the injectors.

An outboard motor according to a preferred embodiment of the present invention includes a crankshaft, a first bank of cylinders (hereinafter "first bank"), a second bank of cylinders (hereinafter "second bank"), a plurality of first injectors, a plurality of first spark plugs, a plurality of second injectors, and a plurality of second spark plugs. The crankshaft extends in a vertical direction. The first bank includes a plurality of first cylinders. Each of the plurality of first cylinders includes a first combustion chamber, a first intake port, and a first exhaust port. The plurality of first cylinders are aligned in the vertical direction. The second bank includes a plurality of second cylinders. Each of the plurality of second cylinders includes a second combustion chamber, a second intake port, and a second exhaust port. The plurality of second cylinders are aligned in the vertical direction. The plurality of first injectors are attached to the first bank. The plurality of first spark plugs are attached to the first bank. The plurality of second injectors are attached to the second bank. The plurality of second spark plugs are attached to the second bank. The plurality of first injectors and the plurality of first spark plugs are alternately disposed in the vertical direction. The plurality of second injectors and the plurality of second spark plugs are alternately disposed in the vertical direction in a reverse order to that of the plurality of first injectors and the plurality of first spark plugs. Each of the plurality of first injectors includes a first opening to inject a fuel with directivity into a corresponding one of the first combustion chambers. Each of the plurality of second injectors includes a second opening to inject the fuel with directivity into a corresponding one of the second combustion chambers. When the crankshaft is seen from a horizontal direction, the plurality of first cylinders and the plurality of second cylinders are disposed symmetrically about a point of symmetry arranged on an axis of the crankshaft.

According to preferred embodiments of the present invention, it is possible to provide an outboard motor in which a common construction is used for fuel supply systems respectively including injectors.

The above and other elements, features, steps, characteristics and advantages of the present invention will become more apparent from the following detailed description of the s with reference to the attached drawings.

DETAILED DESCRIPTION OF THE PREFERRED EMBODIMENTS

Figure 1:
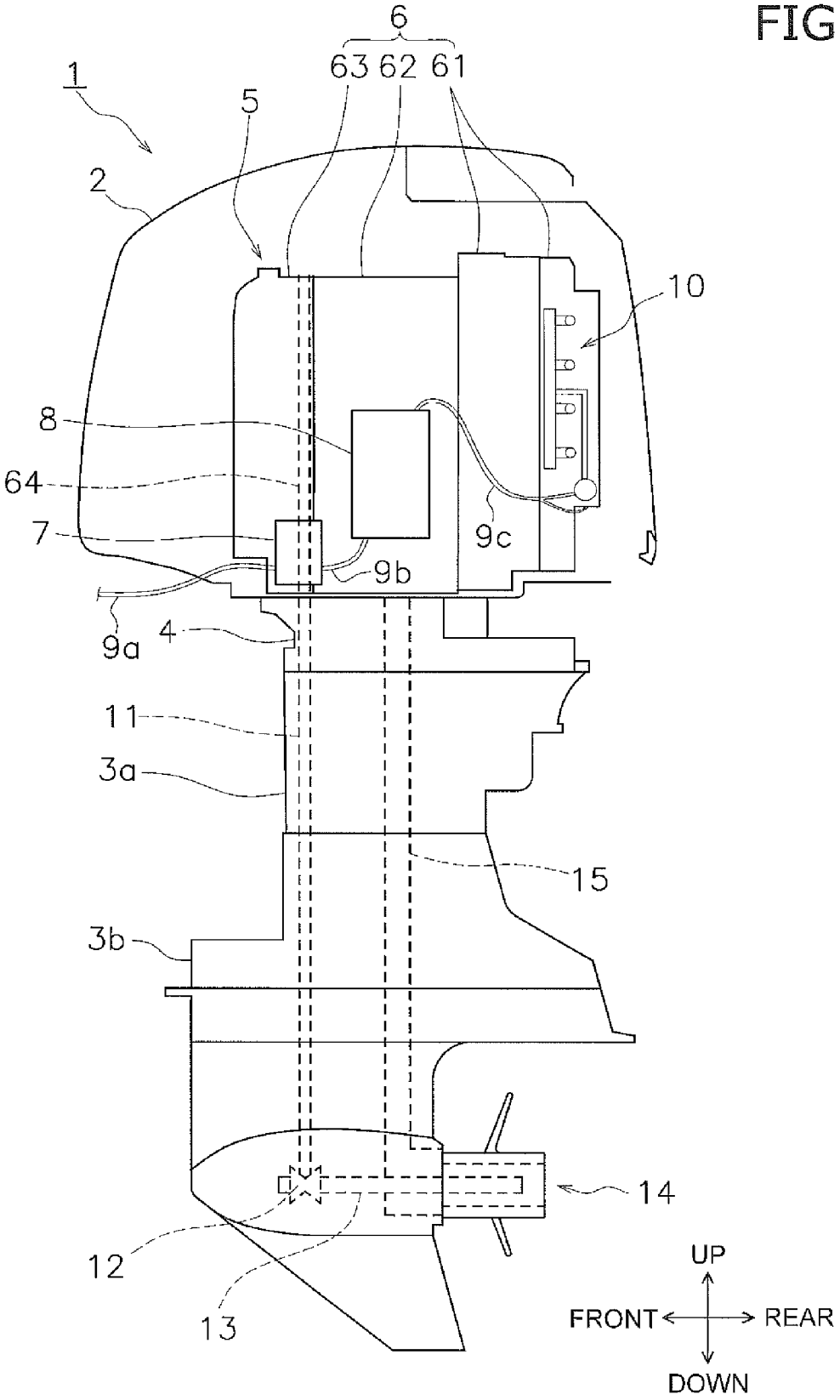
FIG. 1 is a schematic side view of a construction of an outboard motor.

An outboard motor 1 according to a preferred embodiment of the present invention is an outboard motor attachable to a vessel body through a suspension device. FIG. 1 is a schematic side view of a construction of the outboard motor 1.

As shown in FIG. 1, the outboard motor 1 includes an engine cover 2, an upper casing 3*a*, a lower casing 3*b*, an exhaust guide 4, and an engine unit 5.

The engine cover 2, the upper casing 3*a*, and the engine unit 5 are fixed to the exhaust guide 4. The engine cover 2 is disposed over the exhaust guide 4. The upper casing 3*a* is disposed under the exhaust guide 4. The lower casing 3*b* is disposed under the upper casing 3*a*. In the present preferred embodiment, the engine cover 2, the upper casing 3*a*, the lower casing 3*b*, and the exhaust guide 4 define a housing of the outboard motor 1.

The engine unit 5 is disposed inside the engine cover 2. The engine unit 6 includes an engine 6, a low pressure pump 7, an internal fuel tank 8, first to third fuel hoses 9*a* to 9*c*, and a fuel supply device 10.

The engine 6 is preferably an eight-cylinder V engine (V8 engine) of a vertical mount type, for example. The engine 6 includes a cylinder head unit 61, a cylinder block 62, and a crank case 63. The cylinder head unit 61 is connected to the rear side of the cylinder block 62. The cylinder head unit 61 and the cylinder block 62 define a V bank. The crank case 63 is connected to the front side of the cylinder block 62. A crankshaft 64 is disposed inside the crank case 63. The crankshaft 64 extends in the vertical direction. The construction of the engine 6 will be described below.

The low pressure pump 7 is connected to an external fuel tank (not shown in the drawings) disposed in the vehicle body through the first fuel hose 9*a*. The low pressure pump 7 is connected to the internal fuel tank 8 through the second fuel hose 9*b*. The low pressure pump 7 supplies fuel from the external fuel tank to the internal fuel tank 8.

The internal fuel tank 8 stores the fuel supplied by the low pressure pump 7. The internal fuel tank 8 is connected to the fuel supply device 10 through the third fuel hose 9*c*. The construction of the fuel supply device 10 will be described below.

As shown in FIG. 1, the outboard motor 1 includes a drive shaft 9, a bevel gear 12, a propeller shaft 13, a propeller 14, and an exhaust pathway 15.

The drive shaft 11 extends in the vertical direction in the interiors of the upper casing 3*a* and the lower casing 3*b*. The upper end of the drive shaft 11 is coupled to the lower end of the crankshaft 64 of the engine 6. The lower end of the drive shaft 11 is coupled to the front end of the propeller shaft 13 through the bevel gear 12. The propeller shaft 13 extends in the back-and-forth direction in the interior of the lower casing 3*b*. The rear end of the propeller shaft 13 protrudes from the lower casing 3*b* and is coupled to the propeller 14. The propeller 14 is rotated together with the propeller shaft 13. The exhaust pathway 15 extends from the engine 6 to the interior of the propeller 14 through the interiors of the exhaust guide 4, the upper casing 3*a*, and the lower casing 3*b*.

Figure 2:
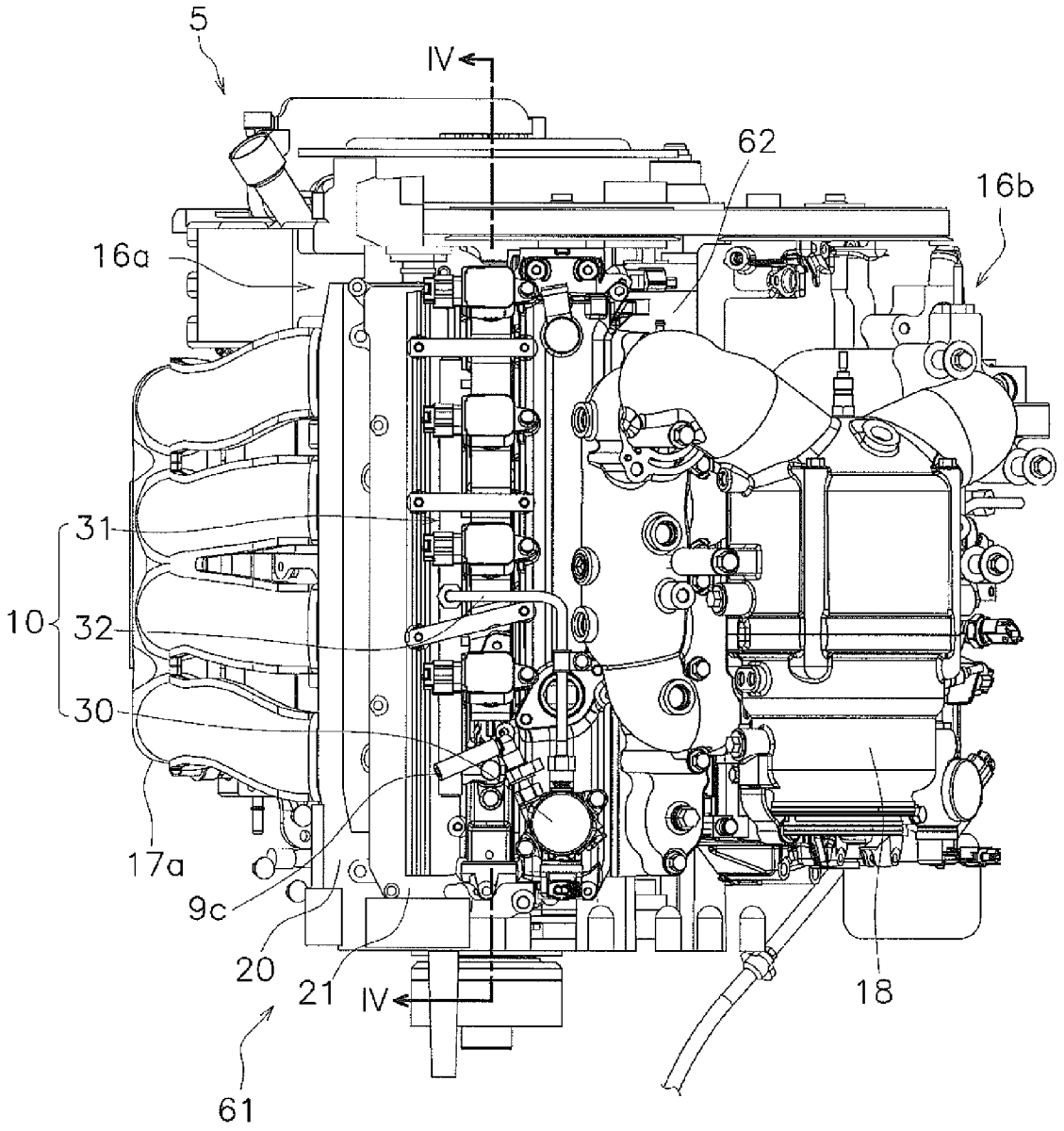
FIG. 2 is a left rear side view of an engine.
Figure 3:
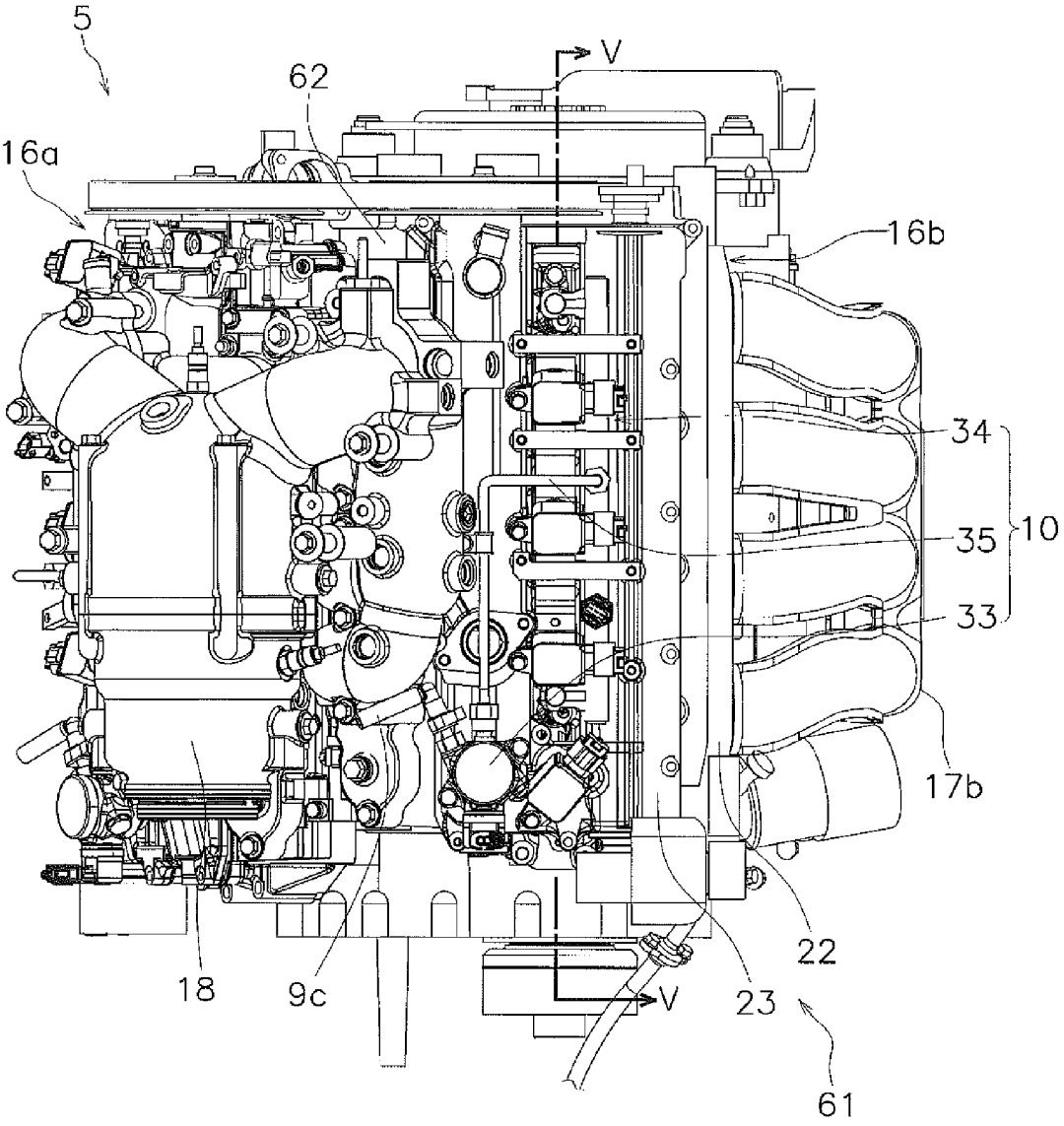
FIG. 3 is a right rear side view of the engine.
Figure 4:
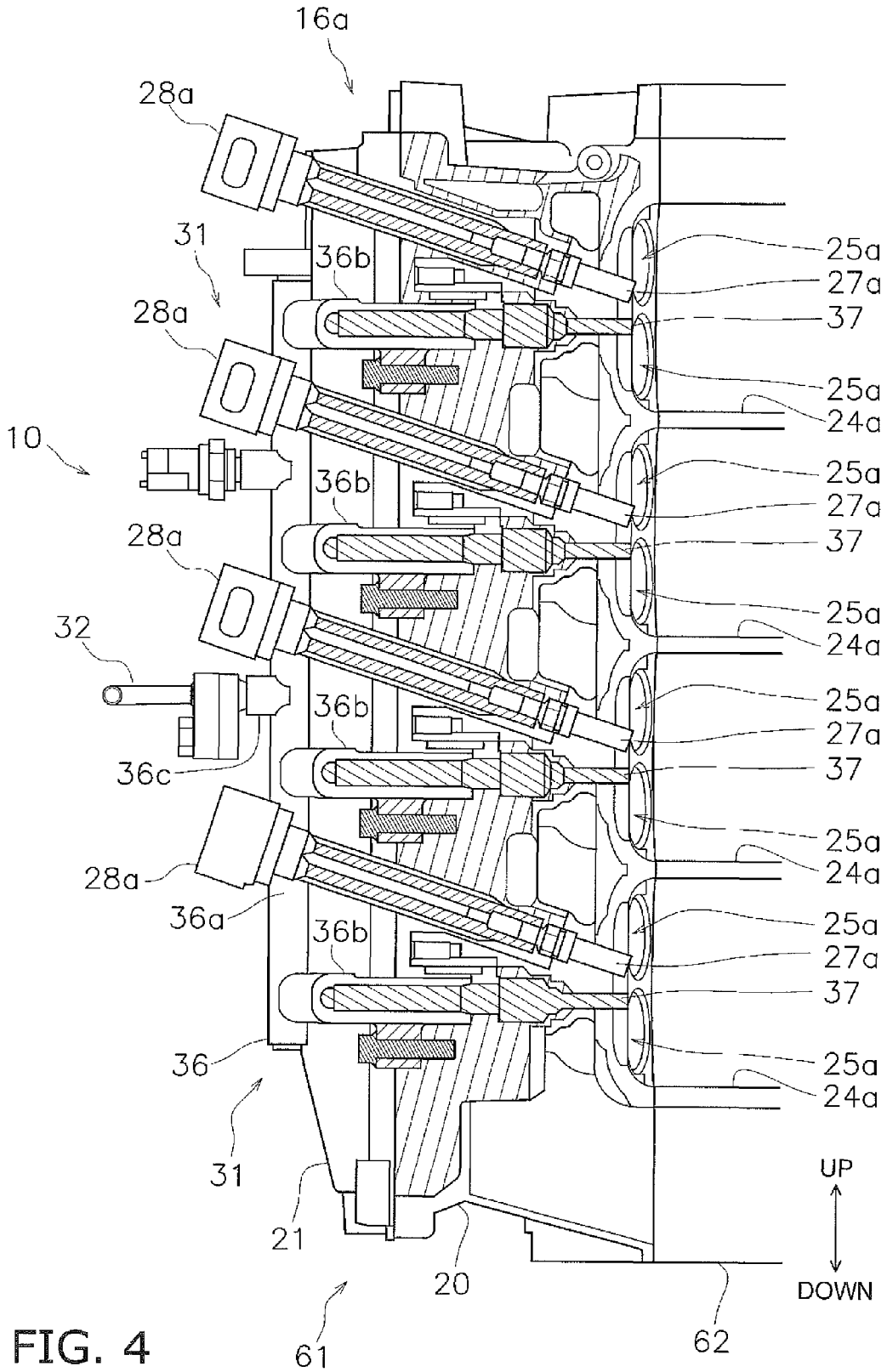
FIG. 4 is a cross-sectional view of FIG. 2 taken along line IV-IV.
Figure 5:
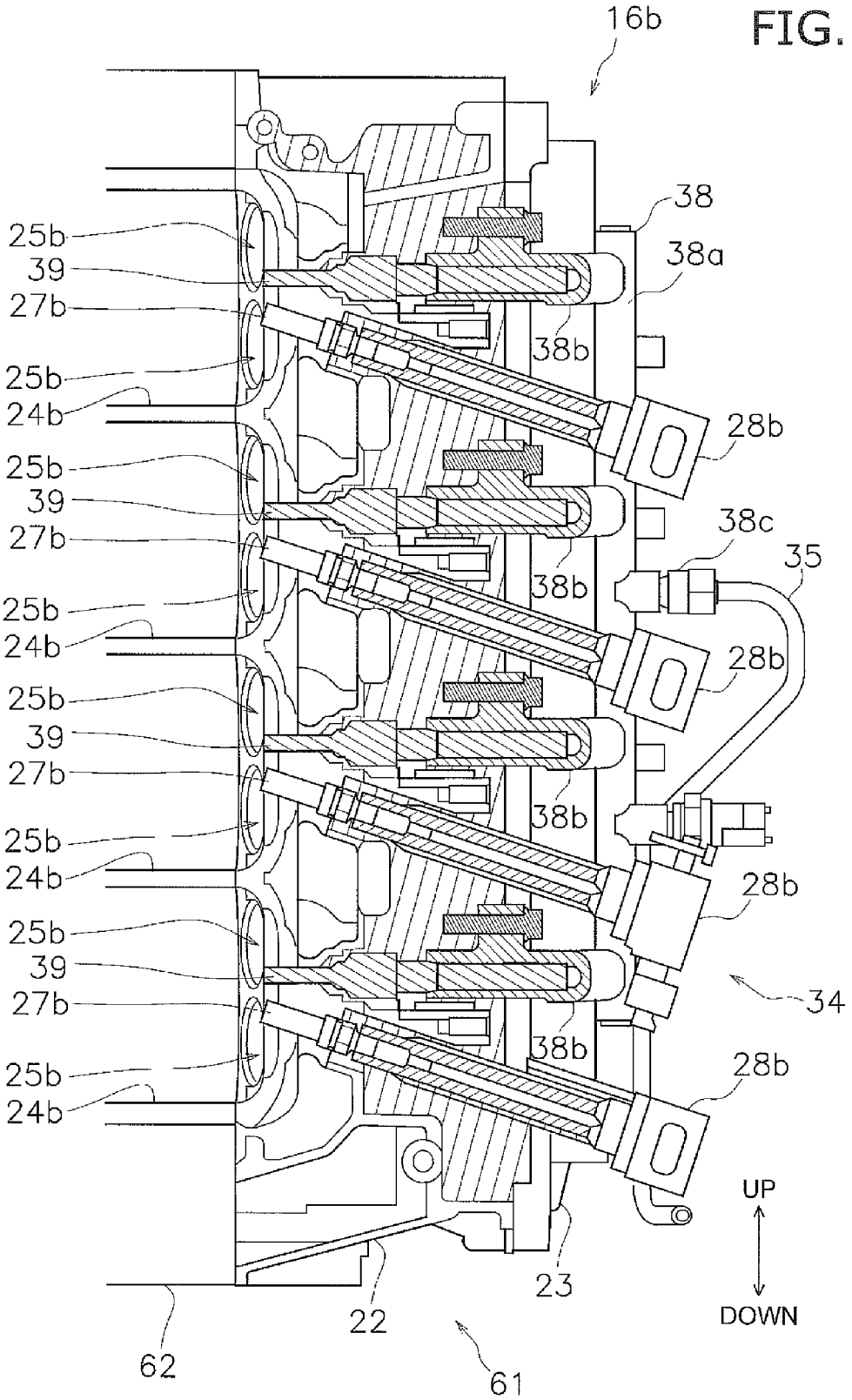
FIG. 5 is a cross-sectional view of FIG. 3 taken along line V-V.

Next, the constructions of the engine 6 and the fuel supply device 10 will be explained. FIG. 2 is a left rear side view of the engine 6. FIG. 3 is a right rear side view of the engine 6. FIG. 4 is a cross-sectional view of FIG. 2 taken along line IV-IV. FIG. 5 is a cross-sectional view of FIG. 3 taken along line V-V.

The engine 6 includes a first bank of cylinders 16*a* (hereinafter "first bank 16*a*"), a second bank of cylinders 16*b* (hereinafter "second bank 16*b*"), a first intake manifold 17*a*, a second intake manifold 17*b*, and an exhaust manifold 18. The first bank 16*a* and the second bank 16*b* are defined by the cylinder head unit 61 and the cylinder block 62. The first bank 16*a* and the second bank 16*b* are preferably similar to each other. The cylinder head unit 61 includes a first cylinder head 20, a first cylinder head cover 21, a second cylinder head 22, and a second cylinder head cover 23.

The first bank 16*a* is defined by the left half portion of the cylinder block 62, the first cylinder head 20, and the first cylinder head cover 21. The second bank 16*b* is defined by the right half portion of the cylinder block 62, the second cylinder head 22, and the second cylinder head cover 23. The first bank 16*a* and the second bank 16*b* are disposed in a V-shape arrangement when the crankshaft 64 is seen from the vertical direction (e.g., from above). The first bank 16*a* is offset from the second bank 16*b* in the vertical direction. In the present preferred embodiment, the first bank 16*a* is preferably located higher than the second bank 16*b* in the vertical direction, for example.

The first intake manifold 17*a* is disposed on the outside of the first cylinder head 20. The first intake manifold 17*a* is connected to the first cylinder head 20. The second intake manifold 17*b* is disposed on the outside of the second cylinder head 22. The second intake manifold 17*b* is connected to the second cylinder head 22.

The exhaust manifold 18 is connected to the first cylinder head 20 and the second cylinder head 22. The exhaust manifold 18 is disposed in the V bank between the first bank 16*a* and the second bank 16*b*.

As shown in FIG. 4, the first bank 16*a* includes four first cylinders 24*a*, eight first intake ports 25*a*, eight first exhaust ports 26*a* (shown not in FIG. 4 but in FIG. 9), four first spark plugs 27*a*, and four first ignition coils 28*a*. The four first cylinders 24*a* are provided in the interior of the left half portion of the cylinder block 62 and the interior of the first cylinder head 20. Each of the four first cylinders 24*a* includes a combustion chamber (exemplary "first combustion chamber") in the interior thereof. The four first cylinders 24*a* are aligned in the vertical direction. Each first cylinder 24*a* is provided with two first intake ports 25*a*, two first exhaust ports 26*a*, and one first spark plug 27*a*. In the present preferred embodiment, the four first spark plugs 27*a* are preferably the same type of components. Each first ignition coil 28*a* is connected to each first spark plug 27*a*. The tip of each first spark plug 27*a* is exposed to the interior of the combustion chamber of each first cylinder 24*a*.

As shown in FIG. 5, the second bank 16*b* includes four second cylinders 24*b*, eight second intake ports 25*b*, eight second exhaust ports 26*b*, (shown not in FIG. 4 but in FIG. 9), four second spark plugs 27*b*, and four second ignition coils 28*b*. The four second cylinders 24*b* are provided in the interior of the right half portion of the cylinder block 62 and the interior of the second cylinder head 22. Each of the four second cylinders 24*b* includes a combustion chamber (exemplary "second combustion chamber") in the interior thereof. The four second cylinders 24*b* are aligned in the vertical direction. Each second cylinder 24*b* is provided with two second intake ports 25*b*, two second exhaust ports 26*b*, and one second spark plug 27*b*. Each second ignition coil 28*b* is connected to each second spark plug 27*b*. The tip of each second spark plug 27*b* is exposed to the interior of the combustion chamber of each second cylinder 24*b*. In the present preferred embodiment, the four second spark plugs 27*b* are preferably the same type of components as the first spark plugs 27*a*. The second spark plugs 27*b* are slanted relative to the horizontal direction. The four second spark plugs 27*b* are parallel or substantially parallel to each other. The tip of each second spark plug 27*b* is exposed to the interior of the combustion chamber of each second cylinder 24*b*.

As shown in FIGS. 2 and 4, the fuel supply device 10 includes a first fuel pump 30, a first fuel delivery assembly 31, and a first fuel pipe 32.

The first fuel pump 30 is attached to the first cylinder head cover 21. The first fuel pump 30 is connected to the internal fuel tank 8 (see FIG. 1) through the third fuel hose 9*c*. The first fuel pump 30 is connected to the first fuel delivery assembly 31 through the first fuel pipe 32. The first fuel pump 30 is a high pressure pump. The first fuel pump 30 pressurizes the fuel stored in the internal fuel tank 8 and transfers the pressurized fuel to the first fuel delivery assembly 31. In the present preferred embodiment, the first fuel pump 30 is closer to the second bank 16*b* than a first delivery pipe 36 is to the second bank 16*b*.

The first fuel delivery assembly 31 is attached to the first cylinder head 20. The first fuel delivery assembly 31 is a fuel supply system for the first bank 16*a*. As shown in FIG. 4, the first fuel delivery assembly 31 includes the first delivery pipe 36 and four first injectors 37.

The first delivery pipe 36 includes a main pipe 36*a*, four first branch pipes 36*b*, and a first attachment portion 36*c*. The first main pipe 36*a* is disposed laterally to the four first ignition coils 28*a*. The first main pipe 36*a* extends in the vertical direction. The four first branch pipes 36*b* are aligned in the vertical direction. The four first branch pipes 36*b* are respectively located lower than the first spark plugs 27*a* in the vertical direction. The four first branch pipes 36*b* are connected to the first main pipe 36*a*. The first branch pipes 36*b* respectively extend from the first main pipe 36*a* toward the first cylinders 24*a*. The first injectors 37 are respectively attached to the tips of the first branch pipes 36*b*. The first attachment portion 36*c* is disposed in the middle of the first main pipe 36*a*. The first fuel pipe 32 is detachably attached to the first attachment portion 36*c*.

In the present preferred embodiment, the four first injectors 37 are preferably the same type of components. The four first injectors 37 are respectively connected to the four first branch pipes 36*b*. The first injectors 37 are attached to the first cylinder head 20. The first injectors 37 are respectively disposed lower than and adjacent to the first spark plugs 27*a* in the vertical direction. The first injectors 37 are disposed along the horizontal direction. The four first injectors 37 are parallel or substantially parallel to each other. The tip of each first injector 37 is exposed to the interior of the combustion chamber of each first cylinder 24*a*.

Figure 6:
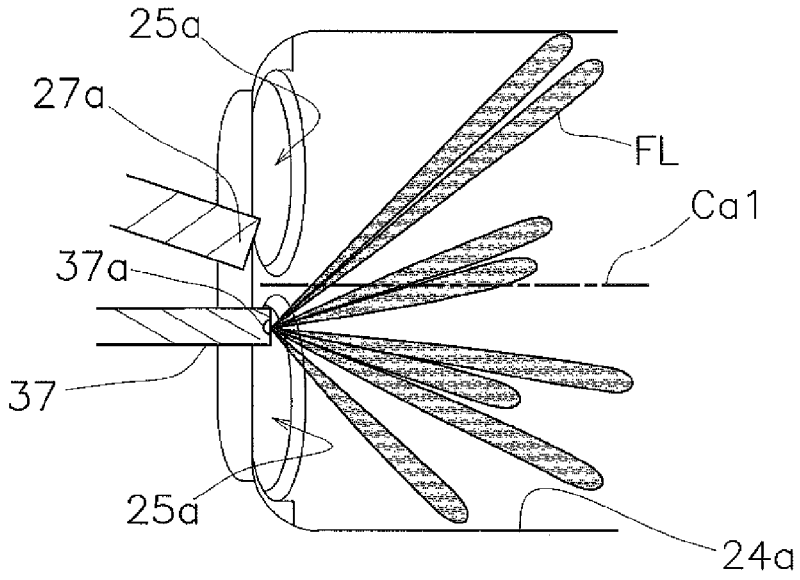
FIG. 6 is a partial enlarged view of FIG. 2.

FIG. 6 is a partial enlarged view of FIG. 4. The tip of each first injector 37 is disposed adjacently to that of each first spark plug 27*a*. Each first injector 37 is center mounted to each first cylinder 24*a*. Each first injector 37 is located in approximately the middle of each first cylinder 24*a* in a view from a direction of a first axis Ca1 of each first cylinder 24*a* (hereinafter referred to as the "axial direction"). Each first injector 37 includes a first opening 37*a* to inject the fuel into the combustion chamber of each first cylinder 24*a* with directivity. Fuel FL is injected from the first opening 37*a* in slanted directions relative to the first axis Ca1. The fuel FL, injected from the first opening 37*a*, scatters anisotropically with respect to the first axis Ca1. In the present preferred embodiment, as shown in FIG. 6, the fuel FL spreads in the shape of a cone from the first opening 37*a* in eight directions. However, the spreading state of the fuel FL is not limited to this.

As shown in FIGS. 3 and 5, the fuel supply device 10 includes a second fuel pump 33, a second fuel delivery assembly 34, and a second fuel pipe 35.

The second fuel pump 33 is attached to the second cylinder head cover 23. The second fuel pump 33 is connected to the internal fuel tank 8 (see FIG. 1) through another third fuel hose 9*c*. The second fuel pump 33 is connected to the second fuel delivery assembly 34 through the second fuel pipe 35. The second fuel pump 33 is a high pressure pump. The second fuel pump 33 pressurizes the fuel stored in the internal fuel tank 8 and transfers the pressurized fuel to the second fuel delivery assembly 34. In the present preferred embodiment, the second fuel pump 33 is closer to the first bank 16*a* than a second delivery pipe 38 is to the first bank 16*a*.

The second fuel delivery assembly 34 is attached to the second cylinder head 22. The second fuel delivery assembly 34 is a fuel supply system for the second bank 16*b*. As shown in FIG. 5, the second fuel delivery assembly 34 includes the second delivery pipe 38 and four second injectors 39.

In the present preferred embodiment, the second delivery pipe 38 is preferably the same type of component as the first delivery pipe 36. The second delivery pipe 38 includes a second main pipe 38*a*, four second branch pipes 38*b*, and a second attachment portion 38*c*. The second main pipe 38*a* is disposed laterally to the four second ignition coils 28*b*. The second main pipe 38*a* extends in the vertical direction. The four second branch pipes 38*b* are aligned in the vertical direction. The four second branch pipes 38*b* are respectively located higher than the second spark plugs 27*b* in the vertical direction. The four second branch pipes 38*b* are connected to the second main pipe 38*a*. The second branch pipes 38*b* respectively extend from the second main pipe 38*a* toward the second cylinders 24*b*. The second injectors 39 are respectively attached to the tips of the second branch pipes 38*b*. The second attachment portion 38*c* is disposed in the middle of the second main pipe 38*a*. The second attachment portion 38*c* is disposed between the middle two of the four second branch pipes 38*b*. The second fuel pipe 35 is detachably attached to the second attachment portion 38*c*.

In the present preferred embodiment, the four second injectors 39 are preferably the same type of components as the first injectors 37. The four second injectors 39 are respectively connected to the four second branch pipes 38*b*. The second injectors 39 are attached to the second cylinder head 22. The second injectors 39 are respectively disposed higher than and adjacent to the second spark plugs 27*b* in the vertical direction. The second injectors 39 are disposed along the horizontal direction. The four second injectors 39 are parallel or substantially parallel to each other. The tip of each second injector 39 is exposed to the interior of the combustion chamber of each second cylinder 24*b*.

Figure 7:
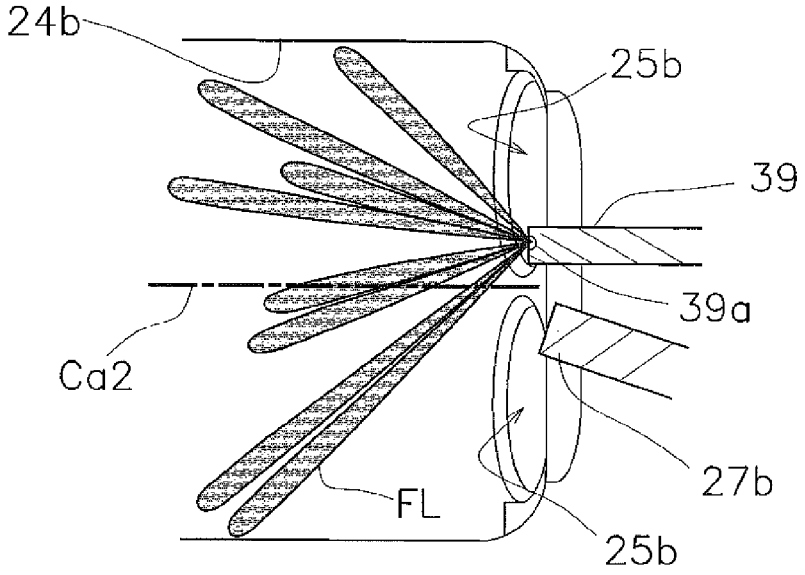
FIG. 7 is a partial enlarged view of FIG. 3.

FIG. 7 is a partial enlarged view of FIG. 5. The tip of each second injector 39 is disposed adjacently to that of each second spark plug 27*b*. Each second injector 39 is center mounted to each second cylinder 24*b*. Each second injector 39 is located in the middle or approximately in the middle of each second cylinder 24*b* in a view from a direction of a second axis Ca2 of each second cylinder 24*b* (hereinafter referred to as "axial direction"). Each second injector 39 includes a second opening 39*a* to inject the fuel into the combustion chamber of each second cylinder 24*b* with directivity. The fuel FL is injected from the second opening 39*a* in slanted directions relative to the second axis Ca2. The fuel FL, injected from the second opening 39*a*, scatters anisotropically with respect to the second axis Ca2. In the present preferred embodiment, as shown in FIG. 7, the fuel FL spreads in the shape of a cone from the second opening 39*a* in eight directions, for example. However, the spreading state of the fuel FL is not limited to this.

Figure 8:
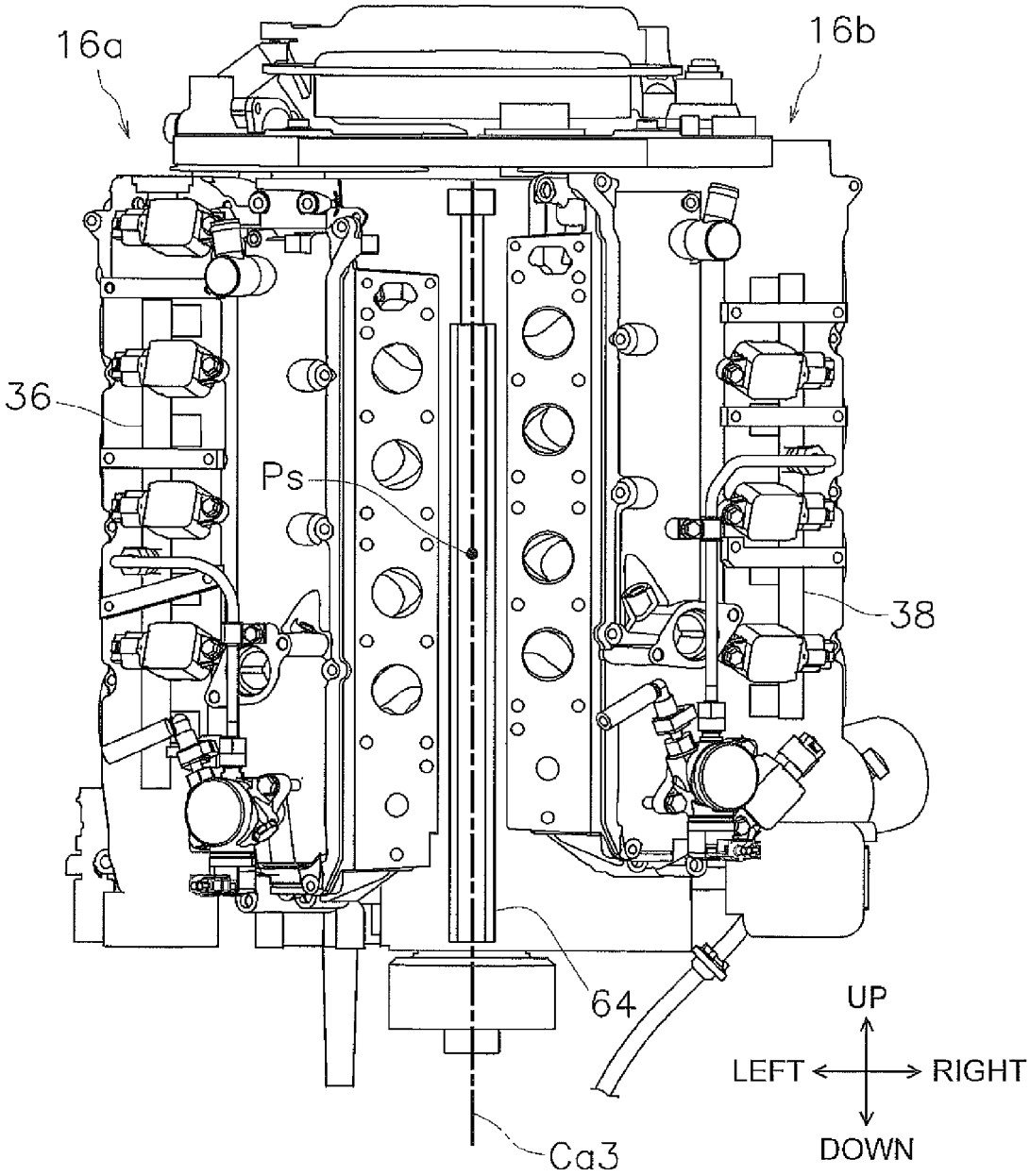
FIG. 8 is a rear side view of the engine.
Figure 9:
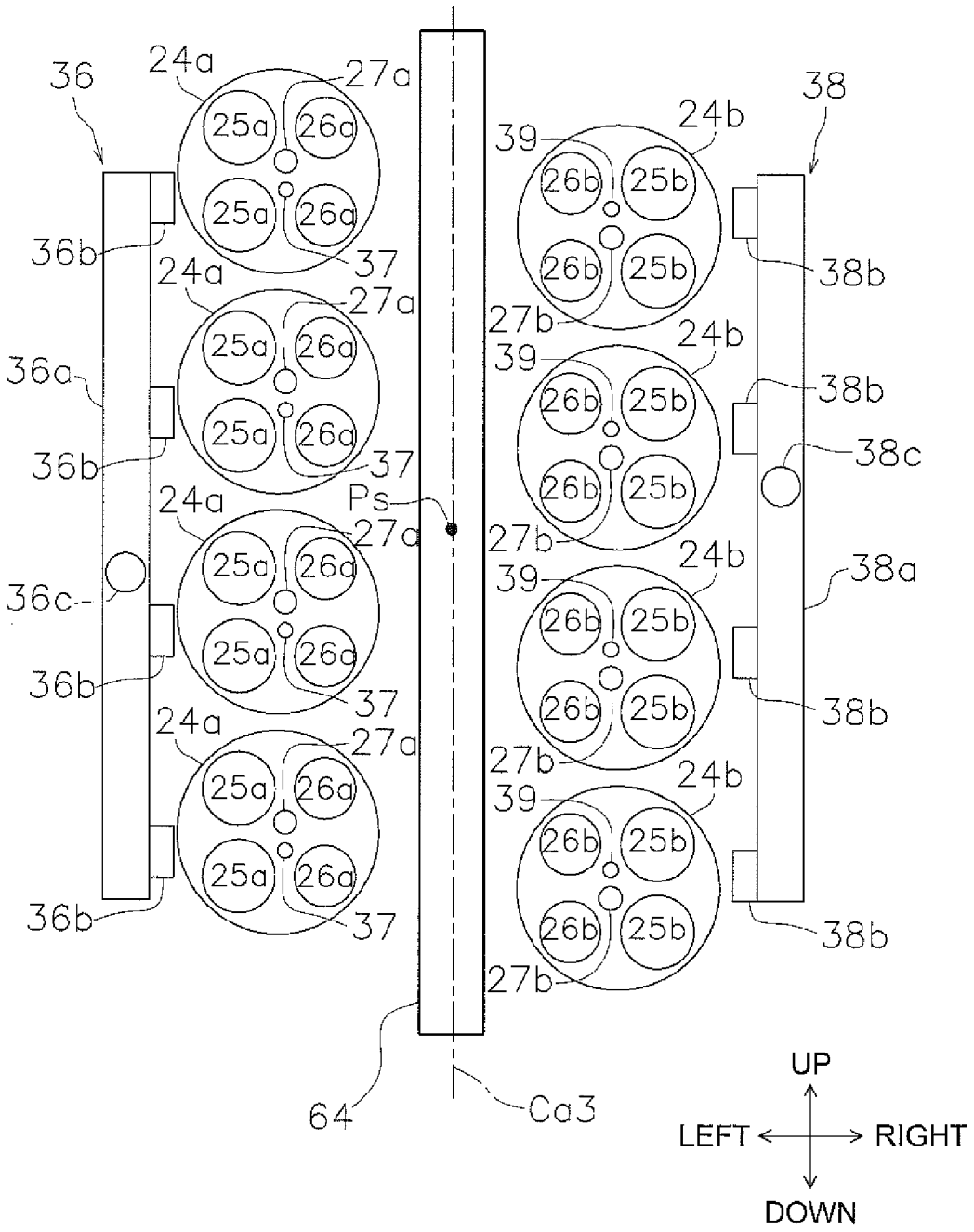
FIG. 9 is a schematic diagram showing positional relationships among a first cylinder, a first delivery pipe, a second cylinder, and a second delivery pipe.

Next, a positional relationship between the engine 6 and the fuel supply device 10 will be explained. FIG. 8 is a rear side view of the engine 6. FIG. 9 is a schematic diagram showing positional relationships among the first cylinders 24*a*, the first delivery pipe 36, the second cylinders 24*b*, and the second delivery pipe 38. FIG. 8 shows a condition of the engine 6 from which the exhaust manifold 18 is detached. FIG. 8 schematically shows a mount position of the crankshaft 64 for convenience of explanation.

As shown in FIG. 8, the first bank 16*a* and the second bank 16*b* are preferably similar to each other. The first bank 16*a* is offset from the second bank 16*b* in the vertical direction. When the crankshaft 64 is seen from the horizontal direction, the first bank 16*a* and the second bank 16*b* are disposed symmetrically about a point of symmetry Ps arranged on an axis Ca3 of the crankshaft 64. When the first bank 16*a* is rotated about the point of symmetry Ps at an angle of 180 degrees (i.e., 180 degrees clockwise or counterclockwise about point of symmetry Ps in FIG. 8 or FIG. 9), the first bank 16*a* and the second bank 16*b* are approximately matched.

As shown in FIG. 9, the four first cylinders 24*a* are aligned in the vertical direction. Each first cylinder 24*a* is provided with two first intake ports 25*a*, two first exhaust ports 26*a*, one first spark plug 27*a*, and one first injector 37.

The first spark plug 27*a* and the first injector 37 are disposed between the two first intake ports 25*a* and the two first exhaust ports 26*a* in the horizontal direction.

The four first injectors 37 and the four first spark plugs 27*a* are alternately disposed in the vertical direction. The four first injectors 37 are respectively disposed under the four first spark plugs 27*a*. In the present preferred embodiment, the four first injectors 37 and the four first spark plugs 27*a* are in straight alignment.

The first delivery pipe 36 is disposed laterally to the four first cylinders 24*a*. The first delivery pipe 36 is disposed on the opposite side of the four second cylinders 24*b* with reference to the four first cylinders 24*a*. When the crankshaft 64 is seen from the horizontal direction, the first delivery pipe 36 is disposed on the outside of the four first cylinders 24*a* with reference to the crankshaft 64.

The four second cylinders 24*b* are aligned in the vertical direction. Each second cylinder 24*b* is provided with two second intake ports 25*b*, two second exhaust ports 26*b*, one second spark plug 27*b*, and one second injector 39. The second spark plug 27*b* and the second injector 39 are disposed between the two second intake ports 25*b* and the two second exhaust ports 26*b* in the horizontal direction.

The four second injectors 39 and the four second spark plugs 27*b* are alternately disposed in the vertical direction. The four second injectors 39 are respectively disposed over the four second spark plugs 27*b*. The second injectors 39 and the second spark plugs 27*b* are disposed in a reverse order to that of the first injectors 37 and the first spark plugs 27*a*. In the present preferred embodiment, the four second injectors 39 and the four second spark plugs 27*b* are in straight alignment.

The second delivery pipe 38 is disposed laterally to the four second cylinders 24*b*. The second delivery pipe 38 is disposed on the opposite side of the four first cylinders 24*a* with reference to the four second cylinders 24*b*. When the crankshaft 64 is seen from the horizontal direction, the second delivery pipe 38 is disposed on the outside of the four second cylinders 24*b* with reference to the crankshaft 64.

When the crankshaft 64 is seen from the horizontal direction, the four first cylinders 24*a* and the four second cylinders 24*b* are disposed symmetrically about the point of symmetry Ps arranged on the axis Ca3 of the crankshaft 64. Therefore, the eight first intake ports 25*a* and the eight second intake ports 25*b* are disposed symmetrically about the point of symmetry Ps. The eight first exhaust ports 26*a* and the eight second exhaust ports 26*b* are disposed symmetrically about the point of symmetry Ps. The four first spark plugs 27*a* and the four second spark plugs 27*b* are disposed symmetrically about the point of symmetry Ps. The four first injectors 37 and the four second injectors 39 are disposed symmetrically about the point of symmetry Ps.

When the crankshaft 64 is seen from the horizontal direction, the first delivery pipe 36 and the second delivery pipe 38 are disposed symmetrically about the point of symmetry Ps arranged on the axis Ca3 of the crankshaft 64. Therefore, the first main pipe 36*a* of the first delivery pipe 36 and the second main pipe 38*a* of the second delivery pipe 38 are disposed symmetrically about the point of symmetry Ps. The four first branch pipes 36*b* of the first delivery pipe 36 and the four second branch pipes 38*b* of the second delivery pipe 38 are disposed symmetrically about the point of symmetry Ps. The first attachment portion 36*c* of the first delivery pipe 36 and the second attachment portion 38*c* of the second delivery pipe 38 are disposed symmetrically about the point of symmetry Ps.

Thus, in the present preferred embodiment, the four first injectors 37 and the four first spark plugs 27*a* are alternately disposed in the vertical direction, whereas the four second injectors 39 and the four second spark plugs 27*b* are alternately disposed in the vertical direction in a reverse order to the four first injectors 37 and the four first spark plugs 27*a*. When the crankshaft 64 is seen from the horizontal direction, the four first cylinders 24*a* and the four second cylinders 24*b* are disposed symmetrically about the point of symmetry Ps arranged on the axis Ca3 of the crankshaft 64.

Therefore, the positional relationship of the first injector 37 with respect to the other constituent elements in each first cylinder 24*a* and that of the second injector 39 with respect to the other constituent elements in each second cylinder 24*b* are matched. Due to this, even when the first injectors 37 and the second injectors 39 respectively have directivity, injectors of the same type are usable as the first injectors 37 and the second injectors 39. Additionally, the positional relationship of the first injector 37 with respect to the other constituent elements in each first cylinder 24*a* and that of the second injector 39 with respect to the other constituent elements in each second cylinder 24*b* are matched. Hence, delivery pipes of the same type are usable as the first delivery pipe 36 and the second delivery pipe 38. Thus, in the outboard motor 1 according to the present preferred embodiment, a common construction is used for the fuel supply system of the first bank 16*a* and that of the second bank 16*b*.

Preferred embodiments of the present invention have been explained above. However, the present invention is not limited to the preferred embodiments described above, and a variety of changes can be made without departing from the scope of the present invention.

The engine 6 described above is preferably a V8 engine of a vertical mount type. However, the engine 6 is not limited to this. The engine 6 may be horizontally mounted. The engine 6 may be an inline engine, a horizontally opposed engine, or so forth. The engine 6 preferably includes at least one or more first cylinders 24*a* and one or more second cylinders 24*b*.

Each first cylinder 24*a* is preferably provided with two first intake ports 25*a*, two first exhaust ports 26*a*, one first spark plug 27*a*, and one first injector 37. However, the construction of each first cylinder 24*a* is not limited to this. Each first cylinder 24*a* may be provided with one first intake port 25*a*, or alternatively, may be provided with three or more first intake ports 25*a*. Each first cylinder 24*a* may be provided with one first exhaust port 26*a*, or alternatively, may be provided with three or more first exhaust ports 26*a*. Each first cylinder 24*a* may be provided with two or more first spark plugs 27*a*. Each first cylinder 24*a* may be provided with two or more first injectors 37.

Each second cylinder 24*b* is preferably provided with two second intake ports 25*b*, two second exhaust ports 26*b*, one second spark plug 27*b*, and one second injector 39. However, the construction of each second cylinder 24*b* is not limited to this. Each second cylinder 24*b* may be provided with one second intake port 25*b*, or alternatively, may be provided with three or more second intake ports 25*b*. Each second cylinder 24*b* may be provided with one second exhaust port 26*b*, or alternatively, may be provided with three or more second exhaust ports 26*b*. Each second cylinder 24*b* may be provided with two or more second spark plugs 27*b*. Each second cylinder 24*b* may be provided with two or more second injectors 39.

Each first injector 37 preferably includes one first opening 37*a*. However, each first injector 37 may include two or more first openings 37*a*.

Each second injector 39 preferably includes one second opening 39*a*. However, each second injector 39 may include two or more second openings 39*a*.

The four first injectors 37 and the four first spark plugs 27*a* are preferably disposed in straight alignment. However, the four first injectors 37 and the four first spark plugs 27*a* may not be disposed in straight alignment.

The four second injectors 39 and the four second spark plugs 27*b* are preferably disposed in straight alignment. However, the four second injectors 39 and the four second spark plugs 27*b* may not be disposed in straight alignment.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An outboard motor comprising:

a crankshaft extending in a vertical direction;

a first bank of cylinders including a plurality of first cylinders aligned in the vertical direction, each of the plurality of first cylinders including a first combustion chamber, a first intake port, and a first exhaust port;

a second bank of cylinders including a plurality of second cylinders aligned in the vertical direction, each of the plurality of second cylinders including a second combustion chamber, a second intake port, and a second exhaust port;

a plurality of first injectors attached to the first bank of cylinders;

a plurality of first spark plugs attached to the first bank of cylinders;

a plurality of second injectors attached to the second bank of cylinders; and a plurality of second spark plugs attached to the second bank of cylinders; wherein the plurality of first injectors and the plurality of first spark plugs are alternately disposed in the vertical direction;

the plurality of second injectors and the plurality of second spark plugs are alternately disposed in the vertical direction in a reverse order to that of the plurality of first injectors and the plurality of first spark plugs;

each of the plurality of first injectors includes a first opening to inject fuel into a corresponding one of the plurality of first combustion chambers;

each of the plurality of second injectors includes a second opening to inject fuel into a corresponding one of the plurality of second combustion chambers; and when the crankshaft is seen from a horizontal direction, the plurality of first cylinders and the plurality of second cylinders are disposed symmetrically about a point of symmetry located on an axis of the crankshaft.

2. The outboard motor according to claim 1, further comprising:

a first delivery pipe connected to the plurality of first injectors; and a second delivery pipe connected to the plurality of second injectors; wherein when the crankshaft is seen from the horizontal direction, the first delivery pipe and the second delivery pipe are disposed symmetrically about the point of symmetry.

3. The outboard motor according to claim 2, wherein the first delivery pipe includes a first main pipe and a plurality of first branch pipes, the first main pipe extending in the vertical direction, and the plurality of first branch pipes respectively connected to the first main pipe and the plurality of first injectors;

the second delivery pipe includes a second main pipe and a plurality of second branch pipes, the second main pipe extending in the vertical direction, and the plurality of second branch pipes respectively connected to the second main pipe and the plurality of second injectors;

the plurality of first branch pipes are respectively located lower than the plurality of first spark plugs in the vertical direction; and the plurality of second branch pipes are respectively located higher than the plurality of second spark plugs in the vertical direction.

4. The outboard motor according to claim 2, further comprising:

a first fuel pump connected to the first delivery pipe; and a second fuel pump connected to the second delivery pipe; wherein the first fuel pump is disposed closer to the second bank of cylinders than the first delivery pipe is to the second bank of cylinders; and the second fuel pump is disposed closer to the first bank of cylinders than the second delivery pipe is to the first bank of cylinders.

5. The outboard motor according to claim 1, wherein each of the plurality of first injectors is located in a middle or approximately a middle of each of the plurality of first cylinders in a view from an axial direction of each of the plurality of first cylinders; and each of the plurality of second injectors is located in a middle or approximately a middle of each of the plurality of second cylinders in a view from an axial direction of each of the plurality of second cylinders.

6. The outboard motor according to claim 5, wherein each of the plurality of first injectors is located along the horizontal direction;

each of the plurality of first spark plugs is slanted relative to the horizontal direction;

each of the plurality of second injectors is located along the horizontal direction; and each of the plurality of second spark plugs is slanted relative to the horizontal direction.

7. The outboard motor according to claim 1, wherein, when the crankshaft is seen from the vertical direction, the first bank of cylinders and the second bank of cylinders are disposed in a V-shape arrangement.

8. The outboard motor according to claim 1, wherein the first bank of cylinders is offset from the second bank of cylinders in the vertical direction.

9. The outboard motor according to claim 1, wherein the plurality of first injectors are components of a same type as the plurality of second injectors.

10. The outboard motor according to claim 2, wherein the first delivery pipe is a component of a same type as the second delivery pipe.

* * * * *